US005203110A

United States Patent [19]

Hörmann

[11] Patent Number: 5,203,110

[45] Date of Patent: Apr. 20, 1993

[54] SAFETY DEVICE FOR THE CLOSING EDGE OF A DOOR LEAF

[75] Inventor: Michael Hörmann, Marienfeld, Fed. Rep. of Germany

[73] Assignee: Marantec Antriebs- und Steuerungstechnik GmbH & Co. Produktions oHG, Marienfeld, Fed. Rep. of Germany

[21] Appl. No.: 663,905

[22] PCT Filed: Jul. 2, 1990

[86] PCT No.: PCT/DE90/00496

§ 371 Date: Aug. 23, 1991

§ 102(e) Date: Aug. 23, 1991

[87] PCT Pub. No.: WO91/00406

PCT Pub. Date: Jan. 10, 1991

[30] Foreign Application Priority Data

Jun. 30, 1989 [DE] Fed. Rep. of Germany ..... 3921641

[51] Int. Cl.[5] ..... E05F 15/02

[52] U.S. Cl. ..... 49/28; 200/61.43

[58] Field of Search ..... 49/26, 27, 28; 200/61.43

[56] References Cited

U.S. PATENT DOCUMENTS

| | | | |
|---|---|---|---|
| 3,303,303 | 2/1967 | Miller | 49/27 |
| 4,351,016 | 9/1982 | Felbinger | 49/28 |
| 4,396,814 | 8/1983 | Miller | 200/61.43 |
| 4,698,967 | 10/1987 | Longora | 49/27 |

FOREIGN PATENT DOCUMENTS

| | | | |
|---|---|---|---|
| 2127207 | 6/1971 | Fed. Rep. of Germany | 49/28 |
| 2246337 | 9/1972 | Fed. Rep. of Germany | 49/28 |
| 1125754 | 8/1968 | United Kingdom | 200/61.93 |
| 1422932 | 1/1976 | United Kingdom | 49/28 |
| 1594577 | 7/1981 | United Kingdom | 49/28 |
| 8100274 | 2/1981 | World Int. Prop. O. | 49/27 |

*Primary Examiner*—Peter M. Cuomo
*Assistant Examiner*—Michael J. Milano
*Attorney, Agent, or Firm*—Max Fogiel

[57] ABSTRACT

A safety arrangement for a motor-driven door or gate used to close building entrances or doorways, in which a vertically movable overhead door consists of one part or a multiple number of parts. An elastically deformable hollow rubber section is provided at the closing edge of the door, and this hollow rubber section has an interior hollow space with first and second ends. At the first end of this hollow space, there is an air pressure-wave receiver signal transformer, whereas an air pressure-wave transmitter is connected to the second end. This transmitter generates a continuous air pressure oscillation having a first pulse duration and a first pulse frequency when the closing edge is freely movable through a path of motion of the door. The continuous oscillation has a second pulse duration which differs from the first pulse duration, and a second pulse frequency differing from the first pulse frequency when the closing edge strikes against an object positioned in the path of motion of the door. The oscillation is continuously generated by the transmitter and is continuously received by the receiver for the purpose of monitoring continuously the closing edge, and detect when the closing edge abuts against an object, so that the movement of the door may be stopped or reversed.

18 Claims, 1 Drawing Sheet

SAFETY DEVICE FOR THE CLOSING EDGE OF A DOOR LEAF

BACKGROUND OF THE INVENTION

This invention relates to a safety device for the closing edge of the door leaf of a door or similar means for closing building entrances or doorways.

It is known to attain, with the aid of door end profiles extending over the width of the door leaf closing edge facing towards the closing direction, not only a sealing effect in the closing position vis a vis the ground but also a safety function of such a kind that an object or person unintentionally getting in the path of motion of the door leaf closing edge produces a signal by compressing the door end profile—usually a hollow section rubber—which signal stops or reverses the door leaf motion which is necessary for reasons of safety, especially with motor-driven door leaves.

In a known construction the door end profile has two electrically conducting paths over its length which upon compression of the ledge or strip by an object engage one another and thus close a contact which triggers the above-mentioned signal. However, maintaining such a contact ready to operate is problematic in practical use of the strip and over the long service life of such a door because oxidation can occur due to atmospheric influence, and penetration of dirt cannot be excluded so that safety of operation of such a door end profile is insufficient (e.g. DE-OS 26 43 505).

In a known construction of the above-mentioned type pneumatic operation is provided in such a manner that upon compression of the air-filled hollow space of the door end strip, formed as a hollow section rubber, a pressure wave signal is generated which, taken off on one end of the hollow space, is supplied to a pressure chamber having a diaphragm which, as consequence, is subject to an excursion and thus triggers the stop or reversing signal. When the hollow section rubber is damaged, for example, cut open by a sharp-edged object, safe operation of such a door end profile is at least put into question. To monitor such a profile or strip as to its readiness for service in the rota of the door leaf opening and closing movements, one has already provided a limit stop on one of the end positions of the door leaf which triggers a monitoring signal in the form of an air pressure pulse (e.g. DE-GM 85 35 506.2). Apart from the fact that the compression of the strip and/or a special strip joining piece or the like taking place in the rhythm of the door movement leads to material fatigue and consequently to lacking operation safety, any monitoring as to readiness for operation of the closing edge safety device during the movement of the door leaf does not take place so that any damage to the hollow section rubber, e.g. by being cut open, which may occur in the course of such a movement and this without the generation of an emergency pulse interpreted as such one, may lead to the loss of operation safety and consequently of the switch-off function.

SUMMARY OF THE INVENTION

Accordingly, it is an object of the invention to provide a safety device for the closing edge of door leafs of the type mentioned in the beginning which guarantees auto-monitoring of operation safety at least over the switch-on period of the door leaf drive.

One remarkable feature of the safety device according to the present invention is that at least beyond the switched-on period of the door leaf drive the air-filled hollow space of the hollow section rubber on the closing edge is subject to a certain pressure oscillation which is analyzed by the receiver as a state of normal operation. This air-pressure oscillation is introduced in the hollow space of the hollow section rubber on a front-side end and is taken off on the other end and supplied to the receiver. For the event that in the course of the door leaf movement the hollow section rubber strikes an object or person being in its motional path, the hollow section rubber will be compressed and thus the pressure oscillation transmission from the transmitter to the receiver "disturbed" within the hollow space so that the receiver, respectively an oscillation analyzer secondary thereto can derive an emergency signal therefrom. If the hollow section rubber is destroyed outside such an emergency case or the conduits of pipes and hoses leading from the transmitter to the hollow space and from there to the receiver are damaged or the transmitter fails, this will always result in a disturbance, respectively interruption of the pressure oscillation for normal operation so that such a disturbance will be interpreted as an emergency signal resulting in the motor drive being stopped or reversed.

It is obvious that the monitoring of operation safety takes place at least over the whole travelling process of the door leaf and at least in the direction of the closing movement. A further special advantage of the structure according to the invention is that the hollow section rubber subject to rough operating conditions can cope with moisture and dirt without losing its operativeness.

Transmitter and receiver can be device in various ways. For example, the transmitter can generate with the aid of a mechanical, oscillating object the rhythmic pressure changes and/or pressure oscillations indicative of normal operation within a closed, air-filled space connected to the hollow space. This applies in a similar way to the construction of the receiver. However, in a preferred embodiment there is provided in the scope of the transmitter a volume displacer for pressure oscillation generation, i.e. means for rhythmically increasing and decreasing the volume of a pressure chamber, while the receiver can be equipped with a pressure feeler which is likewise responsive to changes in the volume of an associated pressure chamber. The volume displacer and/or air pressure feeler can be deviced as a piston pump or the like. In a particularly preferred embodiment there are provided diaphragms as the displacer and feeler for both the transmitter and the receiver which diaphragms are clamped at their rim, respectively and are unilaterally surrounded by correspondingly associated transmitter/receiver pressure chambers which are connected via conduits to the respectively associated front-side end of the hollow section rubber in an air-pressure conducting manner.

The drive of the transmitter diaphragm can be performed so as to take place continuously or pulsating in oscillating movements, thus generating sharp pressure increases. As the driving means solenoids with an oscillating armature, particularly for the pulsating mode of operation, or—in a perferred embodiment—an electric motor are suitable which drives an excitation member arranged in the central area of the diaphragm through an eccentric. With this eccentric a continuous, approximately sinus-shaped oscillation is produced. Instead of the eccentric the driving shaft of the electric motor can be provided with a cam which—in case via a springloaded angle arrangement—produces a shock-like loading of the diaphragm. In a corresponding manner a piston-cylinder-arrangement can be driven.

The air-pressure feeler of the receiver is in a preferred embodiment also formed as diaphragm which unilaterally delimits a receiving pressure chamber communicating with the output-side front end of the hollow space of the hollow section rubber through an air-pressure conducting connection. In this preferred embodiment the diaphragm can be connected to a centrally arranged driving member which controls a signal modulator. This can be, for example, a magnetic body which in association with an induction coil causes corresponding changes in an electric circuit. In a similar manner a capacitive converter can be deviced. So far there is to deal with the generation of analog signals. In the preferred embodiment the driving member cooperates with a light barrier whereby digital signal modulation is obtained. The receiver and/or signal modulator can be followed by an amplitude and/or frequency analyzer circuit which in the case of any disturbance or emergency supplies a stop and/or switch-over signal to the control circuit of the door leaf driving system.

The amplitude of the air pressure wave and/or air pressure oscillation generated by the transmitter in the hollow section rubber can be dependent from environmental influences such as the ambient temperature. Therefore, the scanning of the frequency of this pressure wave or pressure oscillation will be preferably done by the receiver, especially as far as an emergency signal is concerned. Accordingly, the frequency of this air oscillation, respectively this air pressure pulse sequence generated by the transmitter will be dimensioned so that a noise pulse generated by striking an obstacle extends the pulse and/or semioscillation duration of the oscillation or pulse sequence delivered by the transmitter or, however, outlasts plural oscillation and/or pulse processes so that the receiver will be able to recognize such a disturbance of the normal signal and interprete the same as a switch-off and/or switch-over signal for the motor drive. In case of a defect which occurs gradually in the course of air pressure transmission, especially also within the hollow space of the hollow section rubber, in the first line the amplitude of normal osciallation may drop for which reason the analyzing circuit can have an amplitude monitoring system in order to monitor the signal level of the normal signal.

The above-described safety device is particularly suitable for motor-driven door leafs. However, it is also possible to monitor a manually driven door leaf in a corresponding manner in which case an emergency signal or an auto-monitoring defect signal would cause the triggering of a safety catch.

BRIEF DESCRIPTION OF THE DRAWINGS

This and further embodiments of the invention are described in the subclaims, especially in conjunction with the drawings wherein there is shown in:

DESCRIPTION OF THE PREFERRED EMBODIMENTS

Figure 1:
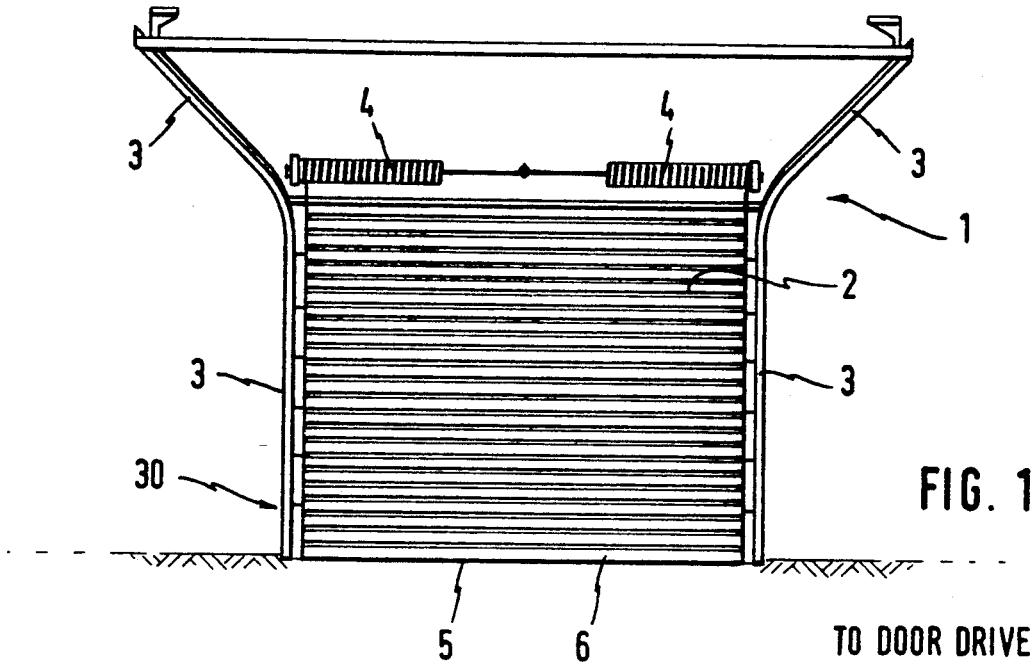
FIG. 1 A perspective interior view of a closed overhead articulated or link door as an example for using a hollow section rubber as a safety strip against accidents.

The overhead link door 1 shown as an example in FIG. 1 is of conventional construction, i.e. the door leaf 2 moves through rollers laterally provided on the door leaf panels in guide ralls 3 having an approximately vertical portion where the rollers of the door leaf 2 are when the door leaf is in its closing position and which change in a curved or arc-shaped manner to a horizontal portion where the rollers are when the door leaf 2 has been completely taken in its opening position. For the counterweight of the door leaf 2 there serve in a manner known per se torsion springs 4 which are arranged on a shaft above the opening of the door and hold the door leaf through cable drums and cables. In the shaft area there can also be provided driving means which may be deviced so as to be working in the form of a tractor haulage in the close-to-cealing area parallel to the horizontal portions of the guide means 3.

Figure 2:
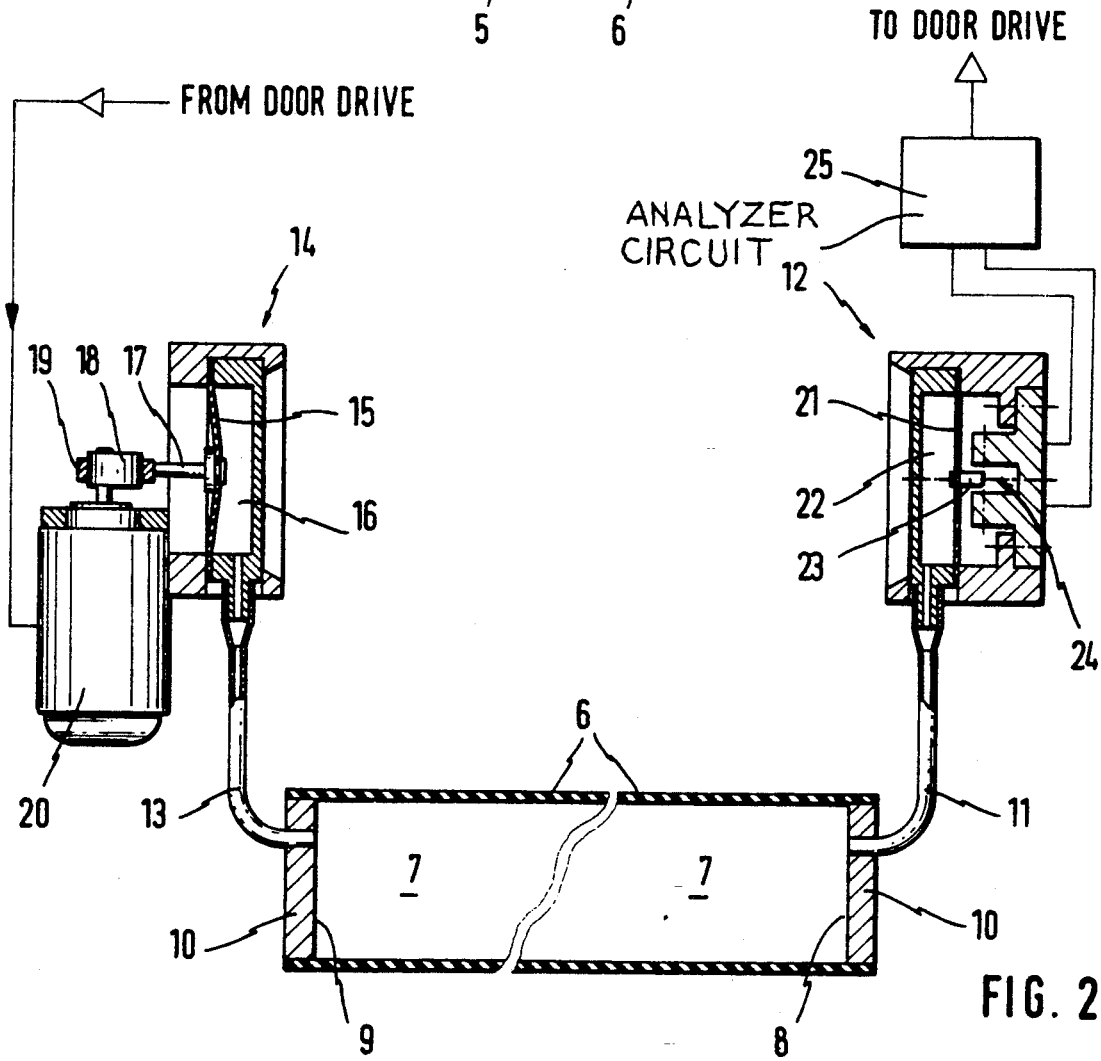
FIG. 2 A schematical, partially sectional representation of a safety device consisting of the hollow section rubber and associated transmitter and receiver.

On the lowermost panel edge in FIG. 1 facing towards the closing direction and forming the closing edge 5 of the door leaf 2 there is provided a door end profile formed as a hollow section rubber 6 which in a manner known per se extends over the width of the door leaf, thus being in the position of detecting obstacles practically over the whole width of the door opening. Such a door end profile, represented in FIG. 2 with a shortened length, must be elastically compressible, with its hollow space changing when being attacked by an obstacle, such as it is the case when it is formed as a hollow section rubber. The hollow space 7 within the walls of the hollow section rubber 6 is bordered on its both front-side ends 8 and 9 by means of front walls 10.

The front-side end 8 of the hollow space 7 facing towards the receiver is connected in an air-pressure-transferring manner via hose pipes to the receiver having a structure which is basically known. The front-side end 9 of the hollow space 7 of the hollow section rubber 6 facing towards the transmitter is connected in a pressure-transferring manner via hose pipes 13 to the air-pressure-wave transmitter which is as a whole designated by reference numeral 14.

As an air volume displacer the transmitter 14 has a diaphragm 15 which in its marginal portion is continuously and tightly held on the side walls of a casing which towards the one side of the diaphragm 15 and together with this diaphragm forms a closed transmitter pressure chamber 16 which is in communication with the front-side input end 9 of the hollow space 7 of the profile 6 through hose pipes 13. In the central portion of the diaphragm 15 there engages an exciting member 17 which extends away from that side of the diaphragm 15 which is away from the chamber 16 and which ends in a ring 19—in case integrally—rotatably surrounding the outer wall surface of an eccentric 18 which, in turn, is unrotatably supported on the output shaft of an electric motor 20 provided as a transmitter driving aggregate. It goes without saying that, when the motor 20 is switched on, the eccentric 18 is put in rotation or revolution so that a sinus oscillation is transmitted to the eccentrically revolving ring 19 and is transformed to an approximately translational motion and transmitted to the diaphragm 15. By virtue of the resulting volume change in the chamber 16 corresponding to the number of rotations of the motor 20, which can be set to different values, there is transmitted a pressure oscillation to the input portion of the hollow space 7 of the profile 6 through the hose pipes 13.

Basically, it would be possible to keep the transmitter 14 permanently in the switched-on state. But, as a rule, one will restrict oneself to an operation responsive to the feeding of the driving motor for which reason the electric motor 20 has an input which is switched responsive to the control for the door drive. The receiver can be performed with delayed response corresponding to the response time of the transmitter which has to be kept short in view of the small masses.

As an air-pressure feeler—in this case, too being responding to a changing volume—the receiver 12 also has a diaphragm 21 which in its marginal zone is held in a casing which together with the one side of the diaphragm 21 closes a receiving pressure chamber 22 which is connected in a pressure-transmitting manner via said hose pipes 11 to the output-side front end 8 of the hollow space 7 of the hollow section rubber 6. The air-pressure wave and/or oscillation or pulse series caused by the transmitter and propagated through the hollow space 7 has a pressure and volume-changing effect in the receiving pressure chamber 22 in such a manner that the diaphragm 21 oscillates or pulsates correspondingly. In the central portion of the diaphragm there is provided a drive member 23 which is directed away from the pressure chamber 22 and controls a light barrier 24, respectively is a part thereof. At the output of this light barrier a correspondingly pulsating, digital output signal occurs representing the pressure changes in the chamber 22 and being supplied to an amplitude-frequency-analyzer circuit 25. This circuit 25 supervises and/or monitors the pressure conditions present at the end 8 of the hollow space 7 of the profile 6 and taken up by the receiver and transformed via said light barrier to electrical pulse signals as to the presence or absence of the air-pressure wave or pulse series caused by the transmitter and representative of normal operating conditions. In case of any failure of the transmitter, interruption of the hose pipes, damage to the hollow section rubber or similar circumstances this pulse series can be completely interrupted or at least weakened to an extent that operation safety of the device is not given any longer. For this event the analyzer circuit 25 will output a locking pulse or switch-off pulse to the control system of the door leaf drive. If, on the other hand, a pulse occurs because the hollow section rubber 6 strikes an obstacle present in the travelling path of the door leaf, thus causing a change of volume of the hollow space 7 of the profile 6, this can be recognized in respect of the air-pressure wave and/or air-pressure pulse series for normal operation in that a time-wise extension or prolongation of a wave or pulse takes place or that an additional pulse is produced by this change of the volume of the hollow space 7 in case of emergency. This disturbance vis à vis the course of pressure at normal operation is analyzed by the analyzer circuit 25 which in case of such a disturbance supplies a corresponding switch-off or switch-over signal to the control system of the door leaf driving system.

In case of larger doors, such as heavy industrial doors, the door leaf is frequently taken in an intermediate position between the complete closing position and the complete opening position, for example, to open the door only for the passage of persons or vehicles having a small height, whereas the complete opening position is required only if a vehicle of a corresponding height has to pass. Accordingly, in practice there takes place a regular change between this intermediate position and the closing position, but no regular change between this intermediate position and the opening position. This means that doors equipped with a safety device which outputs an operation safety pulse only in the completely opened position of the door leaf remain unmonitored over long periods of operation, i.e. over periods where the door leaf is moved only between the closing position and the above-mentioned intermediate position. With the above-described safety device there is avoided that the monitoring is dependent from the respective path of travel of the door leaf.

I claim:

1. A safety arrangement for a motor driven door or gate to close building entrances or doorways, comprising: a vertical movable overhead door of at least one part; a closing edge at a terminal end of said door; an elastically deformable hollow rubber section at said closing edge and having an interior hollow space with first and second ends; an air pressure-wave receiver signal transformer connected to said first end of said gollow space through a first tubular member; an air pressure-wave transmitter connected to said second end of said hollow space through a second tubular member; said transmitter generating a continuous air pressure oscillation having a first pulse duration and a first pulse frequency when said closing edge is freely movable through the entire path of motion of said door, said continuous oscillation having a second pulse duration differing from said first pulse duration and a second pulse frequency differing from said first pulse frequency when said closing edge abuts an object positioned in said path of motion of said door, said oscillation being continuously generated by said transmitter and continuously received by said receiver to monitor continuously said closing edge and detect when said closing edge abuts said object for stopping thereupon movement of said door.

2. A safety arrangement as defined in claim 1, wherein said transmitter comprises a rhythmically-driven air volume displacer; a transmitter pressure chamber connected to said volume displacer for alternatingly and rhythmically increasing the volume of said pressure chamber; said pressure chamber communicating with said second tubular member.

3. A safety arrangement as defined in claim 2, wherein said volume displacer comprises a pulsatingly-driven piston pump.

4. A safety arrangement as defined in claim 2, wherein said volume displacer comprises a diaphragm with a rim and a central area; means for supporting said rim; and an exciting member driven pulsatingly and engaging said central area of said diaphragm.

5. A safety arrangement as defined in claim 1, wherein said air pressure wave transmitter has electromagnetic driving means with an electrical input and mechanical output, said mechanical output being selectively dependent on frequency and amplitude of said electrical input.

6. A safety arrangement as defined in claim 5, wherein said mechanical output has a pulsatingly-driven output member with an armature movable translationally.

7. A safety arrangement as defined in claim 5, wherein said mechanical output has a pulsatingly-driven output member with an armature movable pivotably.

8. A safety arrangement as defined in claim 5, wherein said electromagnetic driving means comprises an electrical motor with an input shaft; and a driven eccentric member on said output shaft.

9. A safety arrangement as defined in claim 1, wherein said receiver signal transformer comprises: an air pressure feeler controlled by air pressures on said first end of said hollow space; a receiving pressure chamber connected to said air pressure feeler and communicating with said hollow space through said first tubular member.

10. A safety arrangement as defined in claim 9, wherein said air pressure feeler comprises a piston pump with an output member; and a signal modulator driven by said output member.

11. A safety arrangement as defined in claim 9, wherein said air pressure feeler comprises a diaphragm with a rim and a central area; means for supporting said rim; and a signal modulator with a driving member arranged in said central area.

12. A safety arrangement as defined in claim 11, wherein said signal modulator comprises a light barrier.

13. A safety arrangement as defined in claim 11, wherein said signal modulator comprises an inductive transformer.

14. A safety arrangement as defined in claim 11, wherein said signal modulator comprises a capacitive transformer.

15. A safety arrangement as defined in claim 1, wherein said receiver signal transformer has selectively amplitude and frequency analyzing means with a secondary discriminating circuit; said analyzer having an output for controlling driving of said door or gate.

16. A safety arrangement as defined in claim 1, wherein said air pressure-wave transmitter has a switching-on input; and drive control of said door or gate connected to said switching-on input.

17. A safety arrangement as defined in claim 1, wherein said first pulse duration is smaller then said second pulse duration.

18. A safety arrangement for a motor driven door or gate to close building entrances or doorways, comprising: a vertical movable overhead door of at least one part; a closing edge at a terminal end of said door; an elastically deformable hollow rubber section at said closing edge and having an interior hollow space with first and second ends; an air pressure-wave receiver signal transformer connected to said first end of said hollow space through a first tubular member; an air pressure-wave transmitter connected to said second end of said hollow space through a second tubular member; said transmitter generating a continuous air pressure oscillation having a first pulse duration and a first pulse frequency when said closing edge is freely movable through the entire path of motion of said door, said continuous oscillation having a second pulse duration differing from said first pulse duration and a second pulse frequency differing from said first pulse frequency when said closing edge abuts an object positioned in said path of motion of said door, said oscillation being continuously generated by said transmitter and continuously received by said receiver to monitor continuously said closing edge and detect when said closing edge abuts said object for stopping thereupon movement of said door; said transmitter comprising a rhythmically driven air volume displacer, a transmitter pressure chamber connected to said volume displacer for alternatingly and rhythmically increasing the volume of said pressure chamber, said pressure chamber communicating with said second tubular member; said volume displacer comprising a pulsatingly-driven piston pump; said air pressure wave transmitter having electromagnetic driving means with an electrical input and mechanical output, said mechanical output being selectively dependent on frequency and amplitude of said electrical input; said mechanical output having a pulsatingly-driven output member with an armature movable translationally; said electromagnetic driving means comprising an electrical motor with an output shaft, and a driven eccentric member on said output shaft; said receiver signal transformer comprising an air pressure feeler controlled by air pressures on said first end of said hollow space, a receiving pressure chamber connected to said air pressure feeler and communicating with said hollow space through said first tubular member; said air pressure feeler comprising a piston pump with an output member, and a signal modulator driven by said output member; said receiver signal transformer having selectively amplitude and frequency analyzing means with a secondary discriminating circuit, said analyzer having an output for controlling driving of said door or gate; said air pressure-wave transmitter having a switching-on input, and feed drive control of said door or gate connected to said switching-on input; said first pulse duration being shorter than said second pulse duration.

* * * * *